United States Patent [19]

Roberts

[11] Patent Number: 4,803,754

[45] Date of Patent: Feb. 14, 1989

[54] ELECTROMECHANICAL DOOR HOLDER-CLOSER

[75] Inventor: Frank D. Roberts, North Reading, Mass.

[73] Assignee: Conrac Corporation, Stamford, Conn.

[21] Appl. No.: 46,156

[22] Filed: May 5, 1987

[51] Int. Cl.[4] ..... E05F 3/00

[52] U.S. Cl. ..... 16/49; 16/DIG. 10; 16/DIG. 17

[58] Field of Search ..... 16/49, 51, 56, DIG. 9, 16/DIG. 10, DIG. 17

[56] References Cited

U.S. PATENT DOCUMENTS

| | | | |
|---|---|---|---|
| 2,108,891 | 2/1938 | Johnson | 16/DIG. 9 |
| 2,244,254 | 6/1941 | Larson | 16/DIG. 9 |
| 2,645,810 | 7/1953 | Galla | 16/DIG. 9 |
| 3,771,823 | 11/1973 | Schnarr | 16/49 |
| 3,935,614 | 2/1976 | Pannone et al. | 16/49 |
| 4,069,544 | 1/1978 | O'Hooge | 16/49 |
| 4,506,407 | 3/1985 | Downey | 16/49 |
| 4,670,939 | 6/1987 | Fisher | 16/DIG. 9 |

*Primary Examiner*—Nicholas P. Godici
*Assistant Examiner*—Edward A. Brown
*Attorney, Agent, or Firm*—Augustus G. Douvas

[57] ABSTRACT

A door holder-closer comprising a conventional door closer and a novel electromechanical door holder attached to the drive spindle of the door closer. The door holder features a lever which is coupled to the drive spindle of the door closer by an adjustable clamp comprising mating rotor and cone elements. Both the rotor and the cone are seated over the drive spindle with the cone being fixed to the spindle. The rotor is formed with a projecting rotor tab which is selectively engaged by a pawl. The lever is formed with a notch which selectively engages a roller driven by an electromagnet-actuated armature. The motion of the door closer spindle is restrained by a primary latch formed when the roller is seated within the lever notch in response to an energized electromagnet, and by a secondary latch formed when the pawl engages the rotor tab. The primary latch supports and controls the secondary latch. Hold-open door control occurs when both latches are in effect concurrently. If the primary latch is broken, either in response to deenergization of the electromagnet or the application of a manual overriding force on the controlled door, the secondary latch is automatically released and the hold-open mode terminates. The hold-open mechanism, which has as its principal components the rotor-cone clamp, the pawl-rotor latch and the electromagnetically actuated lever-roller latch, may be fabricated as a separate and integral unit that is simply seated upon the door-closer drive spindle to add a door-hold function to the door closer.

9 Claims, 6 Drawing Sheets

ELECTROMECHANICAL DOOR HOLDER-CLOSER

BACKGROUND OF THE INVENTION

This invention relates to a door control of the type generally classified as a door holder-closer. A device of this classification has a mechanism for closing a door and an additional mechanism for holding the controlled door at a selected partially or fully open position. In many installations the hold-open mechanism can either be manually overridden, or alternatively, can be electrically released by a remotely located switch. Door holder-closers performing these functions are commonplace in hospitals, schools, public buildings and business establishments where controlled doors enhance safety and security. In certain situations, for example, it is required that particular doors remain partially or fully open at specified times, but these doors are preferably closed automatically in response to an emergency, such as a fire or a security disturbance.

An object of this invention is to provide a door holder-closer with the cost saving, simplicity, and reliability of a mechanical device.

Another object is to provide a door holder-closer with zero fall-off capability, that is, there is no requirement that the door be opened beyond hold-open position to set the mechanism to the hold position.

Another object is to provide an improved door holder-closer which is remotely actuated to both initiate and release the door hold-open function and which is also capable of being manually overridden to close a door.

SUMMARY OF THE INVENTION

A preferred embodiment of the door holder-closer of this invention comprises a conventional door closer and a novel electromechanical door holder attached to the drive spindle of the door closer. The door holder features a lever which is coupled to the drive spindle of the door closer by an adjustable clamp comprising mating rotor and cone elements. Both the rotor and the cone are seated over the drive spindle with the cone being fixed to the spindle. The rotor is formed with a projecting rotor tab which is selectively engaged by a pawl. The lever is formed with a notch which selectively engages a roller driven by an electromagnet-actuated armature. The motion of the door closer spindle is restrained by a primary latch formed when the roller is seated within the lever notch in response to an energized electromagnet, and by a secondary latch formed when the pawl engages the rotor tab. The primary latch supports and controls the secondary latch. Hold-open door control occurs when both latches are in effect concurrently. If the primary latch is broken, either in response to deenergization of the electromagnet or the application of a manual overriding force on the controlled door, the secondary latch is automatically released and the hold-open mode terminates. The hold-open mechanism, which has as its principal components the rotor-cone clamp, the pawl-rotor latch and the electromagnetically actuated lever-roller latch, may be fabricated as a separate and integral unit that is simply seated upon the door-closer drive spindle to add a door-hold function to the door closer.

BRIEF DESCRIPTION OF THE DRAWINGS

In order that all of the structural features for attaining the objects of this invention may be readily understood, reference is made to the accompanying drawings wherein.

DETAILED DESCRIPTION OF THE PREFERRED EMBODIMENTS

Figures 1, 2:
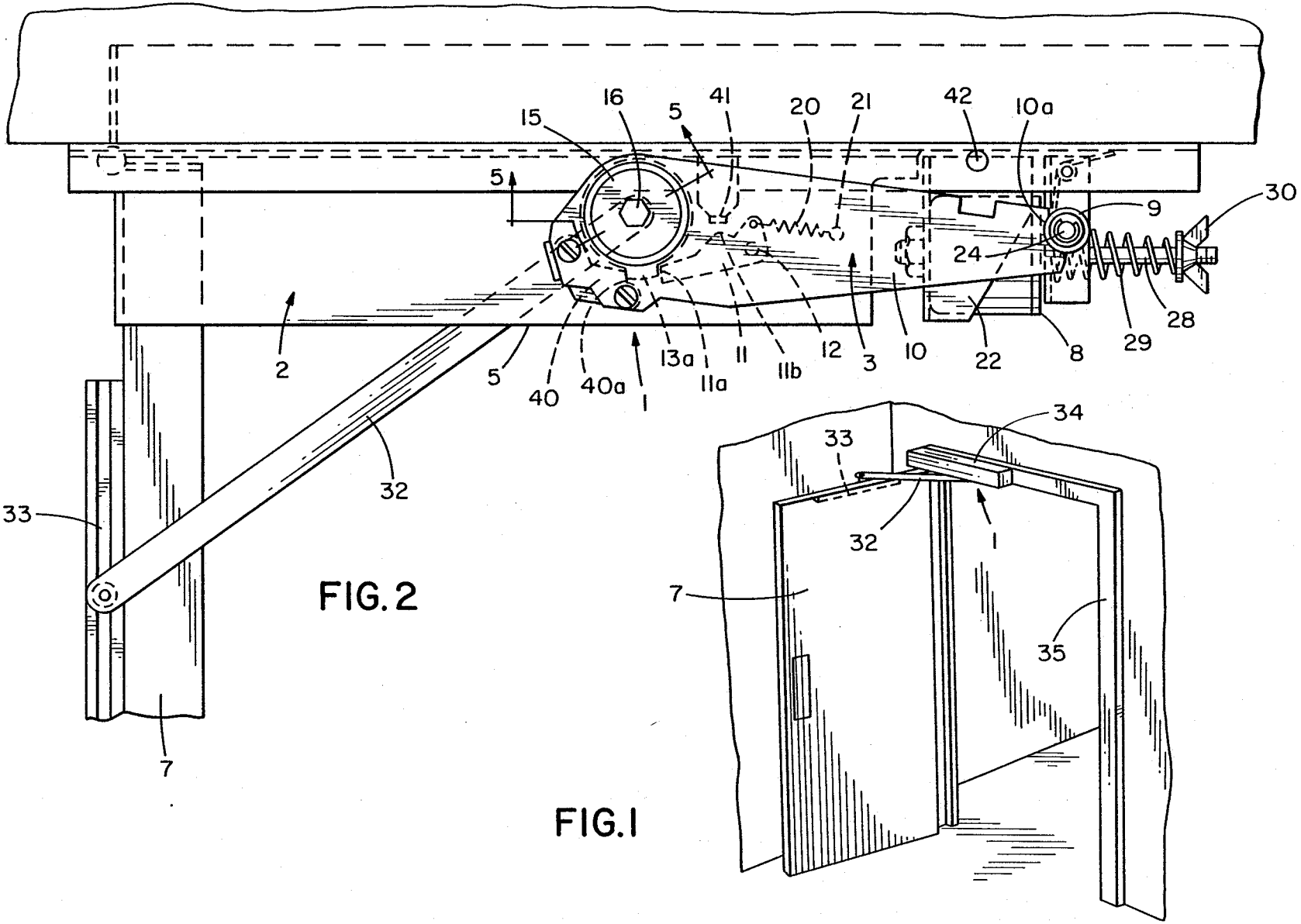
FIG. 1 is a perspective view showing the application of the electromechanical door holder-closer of this invention to a door held in the door-open position.
FIG. 2 is a fragmentary plan view of the structure of FIG. 1 with the door holder-closer cover removed to show the components held in a door hold-open position in response to an energized electromagnet.
Figure 3:
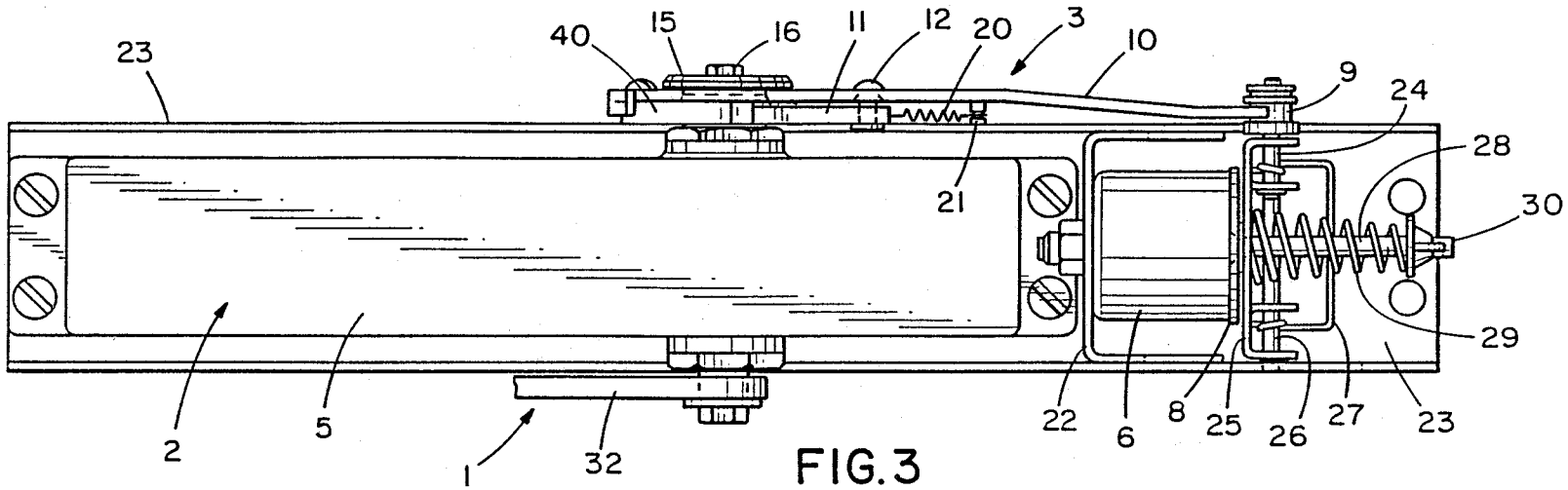
FIG. 3 is a front elevation view of the structure of FIG. 2.

Referring to the drawings, electromechanical door holder-closer 1 of this invention (FIGS. 1 and 2) comprises a conventional door closer 2 and a novel electromechanical door holder 3 attached to drive spindle 4 (FIG. 5) of door closer 2.

Door closer 2 performs the typical functions of door checking in the door opening mode, and door closing and checking in the door closing mode. Door holder 3 is mounted on the exterior of closer housing 5 as an attachment to lock spindle 4 at an adjustable hold-open angle (FIG. 11), ranging from approximately 0 to 180 angular degrees, partly in response to the energization of electromagnet 6. Door 7 is released in response to the deenergization of electromagnet 6, or a manual-override closing force applied to door 7.

A brief preliminary description of the hold-open function of door holder-closer 1, and both electrical and manual-override door release is as follows:

When electromagnet 6 is energized and door 7 is thereafter moved to the selected door hold-open angle (90 degrees in FIG. 2), two concurrent primary an secondary restraining forces are applied to spindle 4 through lever 10 and pawl 11 to hold the door at the hold-open position.

The primary restraining force is developed by energized electromagnet 6 actuating electromagnet armature 8 to drive roller 9 into engagement with latch face 10*a* of lever 10.

The secondary restraining force is developed by the engagement of pawl 11, carried on lever 10 by pivot pin 12, with rotor tab 13*a* of rotor 13 (FIG. 2). Rotor 13 is thus held in a fixed position relative lever 10. Rotor 13 in turn holds cone 14 in a fixed position relative lever 10, because the frustoconical surface 14*a* (FIG. 7) of cone 14 is frictionally locked to the mating frustoconical surface 13*b* of rotor 13. Cone 14 is fixed to spindle 4, thus the restrained cone keeps spindle 4 from turning.

The concurrent restraining forces exerted on spindle 4 by the latching engagement of rotor tab 13*a* by pawl 11 and the latching engagement of lever latch face 10*a* by roller 9 hold drive spindle 4 in the hold-open position of FIG. 2.

When electromagnet 6 is deenergized, armature 8 is released (FIG. 8), thus releasing the force which has held roller 9 in contact with latch face 10*a* of lever 10. The closing force exerted on spindle 4 by the closer spring (not shown) within door closer 2 is now capable of rotating lever 10 and forcing roller 9 out of engagement with latch face 10*a*. Continued rotation of lever 10 brings pawl release cam 11*b* of pawl 11 into contact with pawl release tab 41 camming pawl latch end 11*a* out of contact with rotor tab 13*a*. Door closer spindle 4 is now totally disconnected rotationally from lever 10 and can move door 7 to complete close position.

Manual override of door hold-open (FIG. 9) is effected by applying sufficient force on door 7, in the closing direction, to overcome the engagement force of roller 9 generated by spring 29, to thus allow latch face 10*a* of lever 10 to force roller 9 out of engagement. Continued rotation of lever 10 brings pawl release cam 11*b* of pawl 11 into contact with pawl release tab 41 camming pawl latch end 11*a* out of contact with rotor tab 13*a*. Door closer spindle 4 is now totally disconnected rotationally from lever 10 and can move door 7 to compete close position.

The detailed structure, installation and mode of operation of door holder-closer 1 is as follows:

An understanding of the selective holding forces applied to spindle 4 by rotor 13 and cone 14, rotor tab 13*a* and pawl 11, and lever 10 by roller 9 which is selectively controlled by electromagnet 6 is basic to an understanding of the operation of the holder-closer.

Figure 5:
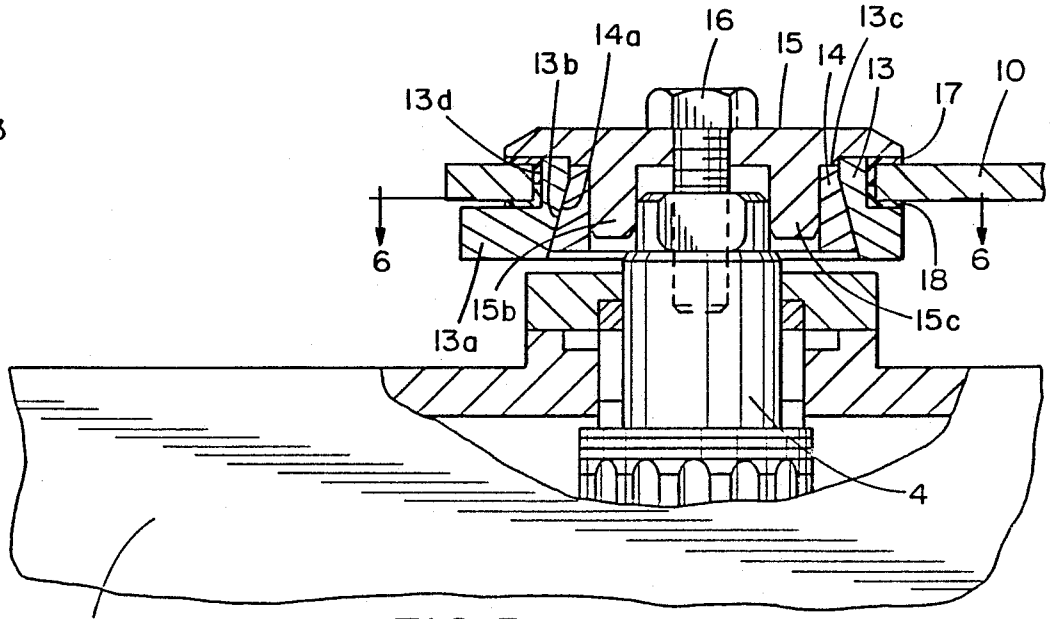
FIG. 5 is a section view taken along line 5—5 of FIG. 2 showing details of the rotor-cone clamp for adjusting the door hold-open angle.
Figure 6:
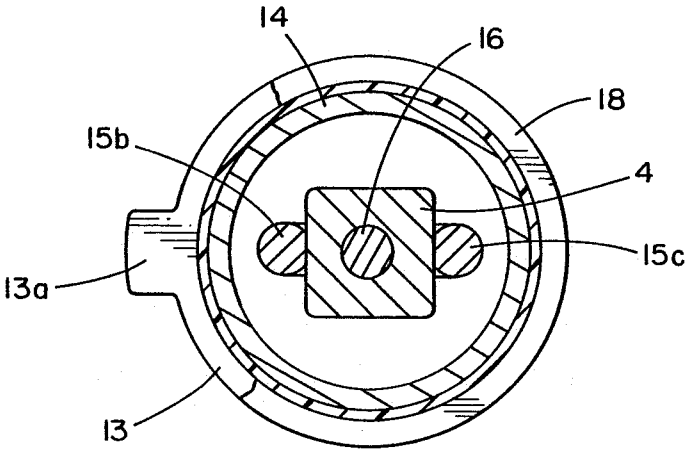
FIG. 6 is a section view taken along line 6—6 of FIG. 5 showing the disposition on the drive spindle of the rotor-cone structure for adjusting the door hold-open angle.
Figure 7:
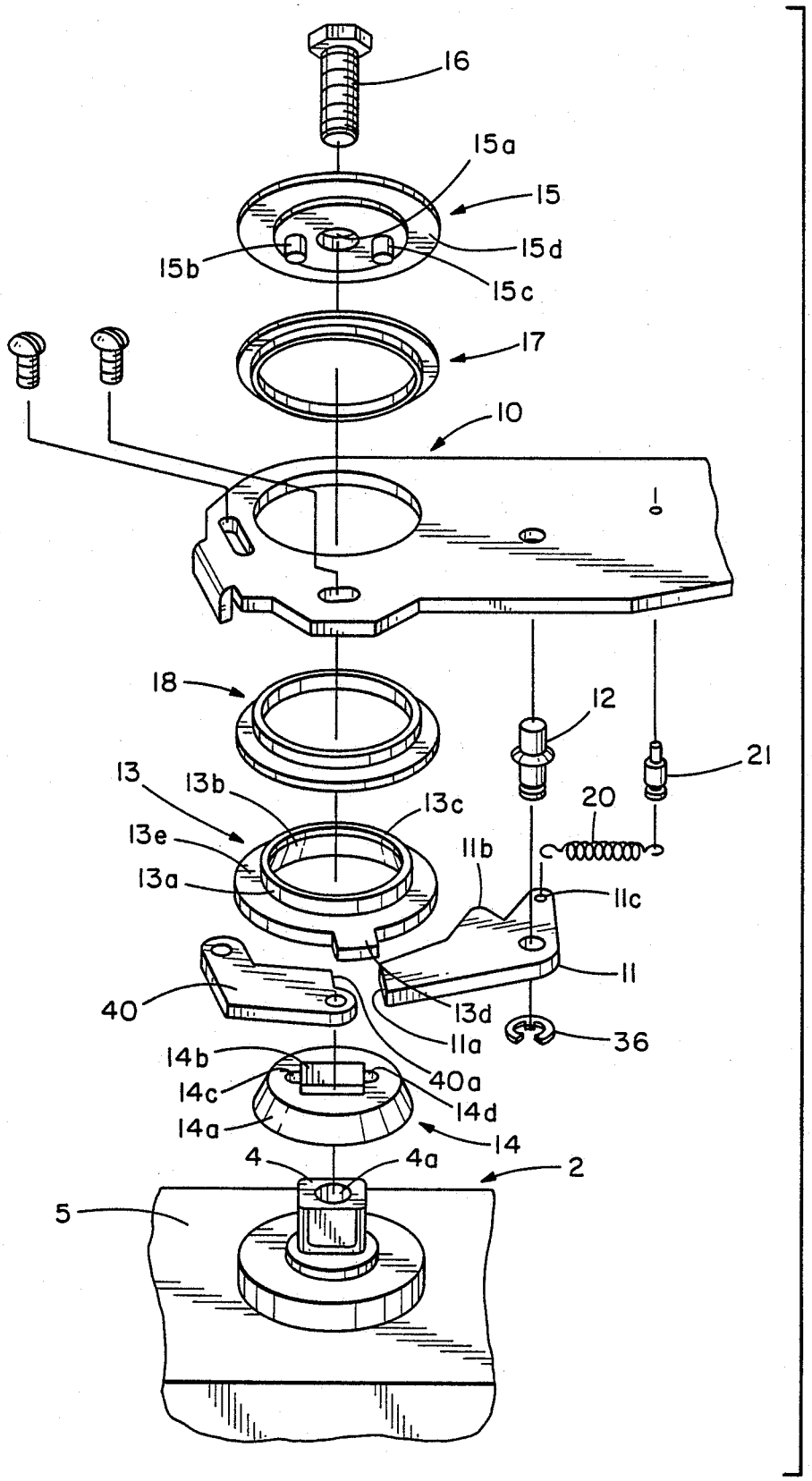
FIG. 7 is an exploded view showing the several components which are mounted on the drive spindle.

The selective clamp provided by pawl 11, rotor 13 and cone 14 which restrains spindle 4 relative to lever 10 is best understood by referring to FIGS. 5, 6 and 7.

Cone 14 is formed with a central square hole 14*b* (FIG. 7) which is seated over and keyed to the mating square shank of spindle 4. Therefore, spindle 4 and cone 14 always move together. As previously described, cone 14 is formed with an exterior frustoconical surface 14*a*. Rotor 13 is seated on cone 14 with the interior frustoconical rotor surface 13*b* frictionally contacting and mating with cone conical surface 14*a*. The frictional clamp between conical surfaces 13*b* and 14*a* is controlled by clamping bolt 16 which passes through hole 15*a* of spindle cap 15 to engage the mating interior threads of spindle hole 4*a*. Spindle cap 15 bears directly on end face 13*c* of rotor 13. A pair of spaced alignment pins 15*b* and 15*c*, project from the interior surface of spindle cap 15 to engage alignment holes 14*c* and 14*d*, located in cone 14. Cap 15 is thus rotationally fixed relative to cone 14 and spindle 4. Tightening of clamping bolt 16 frictionally locks rotor 13 to cone 14 and, therefore, to spindle 4. This mechanism provides the capability of selectively positioning rotor tab 13*a* relative to spindle 4 thus providing selective adjustment of door hold open degree.

Bearing surface 13*d* and thrust face 13*e* of rotor 13, in combination with thrust face 15*d* of spindle cap 15, support bearing rings 17 and 18, which in turn support lever 10. This bearing allows spindle 4 and related parts to rotate freely relative to lever 10 except when latched by pawl 11.

Pawl 11 latches rotor 13 by capturing rotor tab 13*a* between pawl latch end 11*a* and rotor tab stop 40. Rotor tab stop 40 is attached to the bottom or closer 2 side of lever 10. Stop 40 is spaced from pawl latch end 11*a* so that rotor tab 13*a* is tightly sandwiched between these elements during door hold-open.

Pawl 11 is pivoted on pivot pin 12, which is fixed to lever 10. Pawl 11 is retained on pawl pin 12 by E-clip 36. Pawl bias spring 20 is tensioned between spring anchor pin 21 and spring eye 11*c* of pawl 11 so that the spring normally urges pawl 11 into contact with adjacent periphery of rotor 13 and rotor tab 13*a*.

Figure 10:
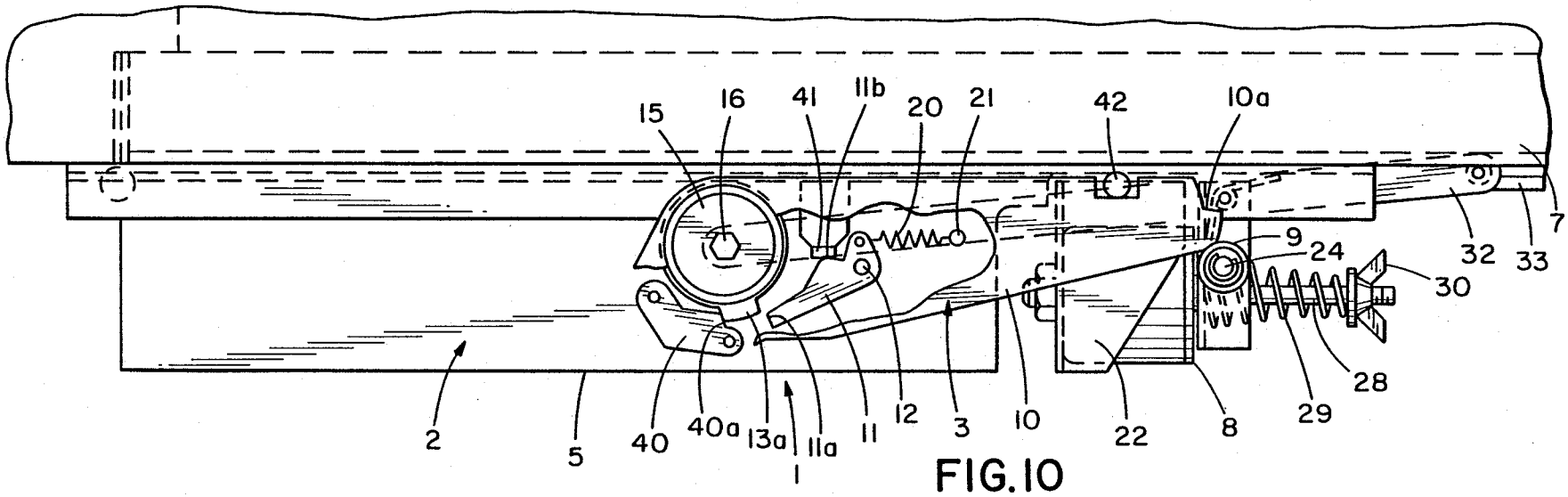
FIG. 10 is a fragmentary plan view showing the components positioned with the lever in the full released position and the door closer spindle having turned approximately 9 degrees from hold-open position.

Pawl release tab 41 is attached to holder-closer frame 23 and is so positioned to interact with pawl release cam 11*b*. When lever 10 moves from hold-open position (FIG. 2), in response to rotation of spindle 4, to released position against lever stop 42 (FIG. 10) pawl release cam 11*b* contacts pawl release tab 41 causing pawl latch end 11*a* to disengage rotor tab 13*a*, thus allowing continued rotation of spindle 4 without corresponding rotation of lever 10.

Figure 4:
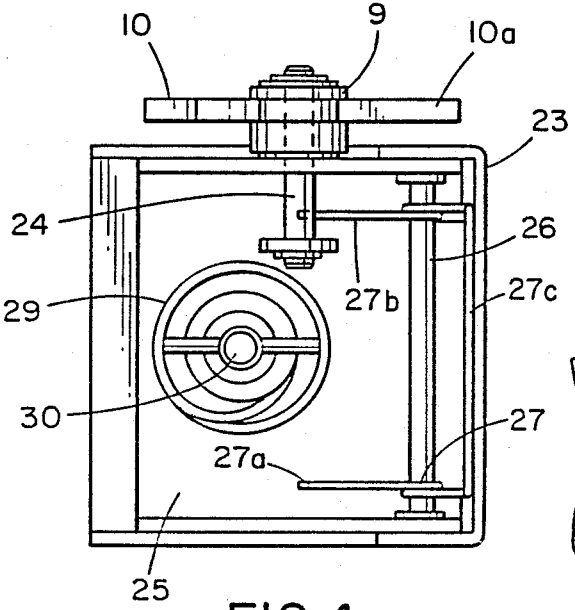
FIG. 4 is an end elevation view showing details of the structure cooperating with the armature and lever.

The selective engagement of lever 10 by roller 9 is best understood by referring to FIG. 4 and also to FIGS. 2, 3, 8–11.

Roller 9 is carried on shaft 24, and shaft 24 is supported on armature pivot plate 25. Pivot plate 25 is carried on pivot pin 26 which is journaled to frame 23. Spring 27 envelops pin 26 with spring ends 27*a* and 27*b* contacting pivot plate 25 and central spring portion 27*c* resting on frame 23. Spring 27 exerts a biasing force on pivot plate 25 which drives armature 8 into normal contact with electromagnet 6 whether or not electromagnet 6 is energized.

Figure 9:
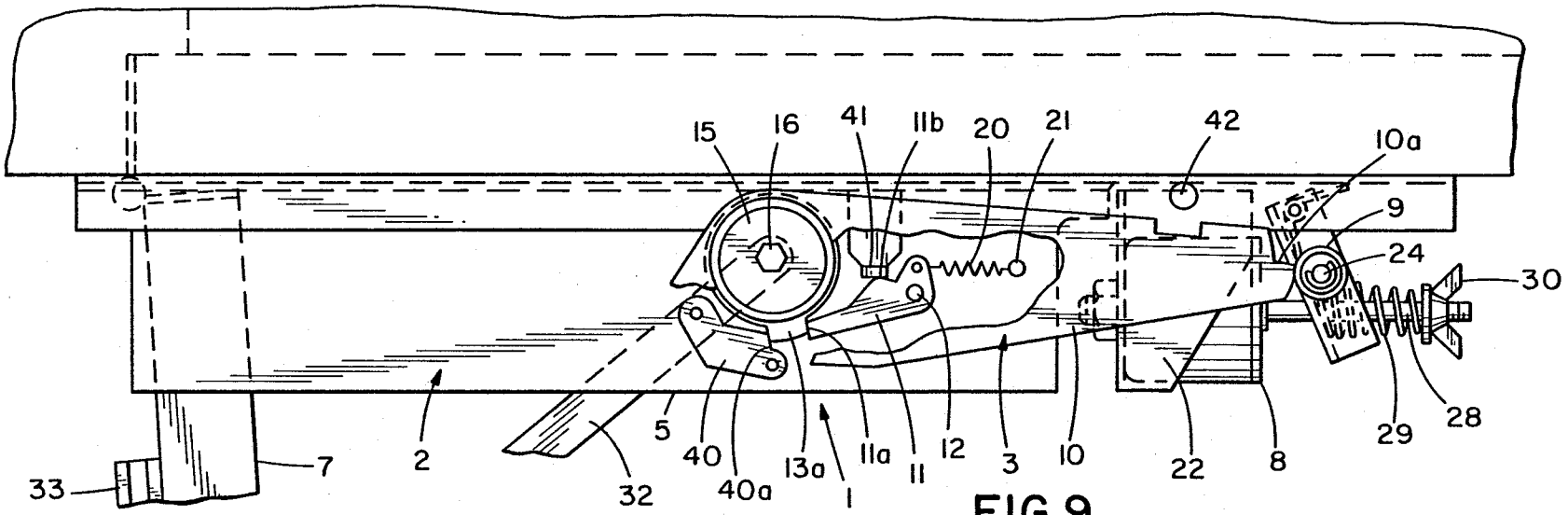
FIG. 9 is a fragmentary plan view showing the release of the lever-roller latch in response to a manual override force.

Armature 8 is yieldingly supported on and pivots with pivot plate 25. Bolt 28 passes through armature 8 and pivot plate 25. Helical spring 29 envelops the shaft of bolt 28, with one end of spring 29 resting on pivot plate 25, and adjusting nut 30 exerting a spring compression force on the opposite end of spring 29. Manual adjustment of nut 30 on bolt 28 varies the force of spring 29 which is exerted on roller 9. This provides an adjustment of the force which lever 10 must exert on roller 9 to effect a manual override of hold-open (FIG. 9). During this override mode, electromagnet 6 holds armature 8. Spindle 4 rotates in response to a manual force applied to door 7 in the closing direction. Lever 10 carried by spindle 4 overcomes latch force on roller 9 camming it out of engagement with latch face 10*a*; thus, pivoting plate 25, and compressing spring 27. As lever 10 continues to move with the rotation of spindle 4, roller 9, acting on the cam surface 10*b* of lever 10, causes a reversal of direction of forces on lever 10. This reversal of forces removes all load from pawl 11 so that as lever 10 moves toward its full released position (FIG. 10) and pawl release cam 11*b* of pawl 11 comes into contact with pawl release tab 41, pawl latch end 11*a* is cammed out of its latch position of engagement with rotor tab 13*a*. At this point, lever 10 comes to rest against lever stop 42 (FIG. 10) and spindle 4 continues rotation to effect door closing. It should be emphasized here that the pawl 11 is never disengaged while under load.

The initial installation and adjustment of door holder-closer 1 is as follows:

In a typical installation, door holder-closer 1 is fixed to door frame 35 with arm 32 and track 33 coupling closer spindle 4 to door 7 in a conventional manner. Cover 34 is removed so that clamping bolt 16 can be loosened and rotor 13 can be rotated relative cone 14. With a specified hold-open angle (90 degrees, for example, FIGS. 2 and 11) and electromagnet 6 preferably deenergized, and latch face 10*a* seated against roller 9, door 7 is manually opened to 90 degrees relative to door frame 35 (FIG. 2), and rotor 13 is manually rotated clockwise until rotor tab 13*a* is engaged by pawl latch end 11*a*. Bolt 16 is thereafter manually tightened until rotor 13 and cone 14 are fixed relative one another. Door 7 is then returned to the closed position. Cover 34 is then reapplied to door holder-closer 1.

Figure 11:
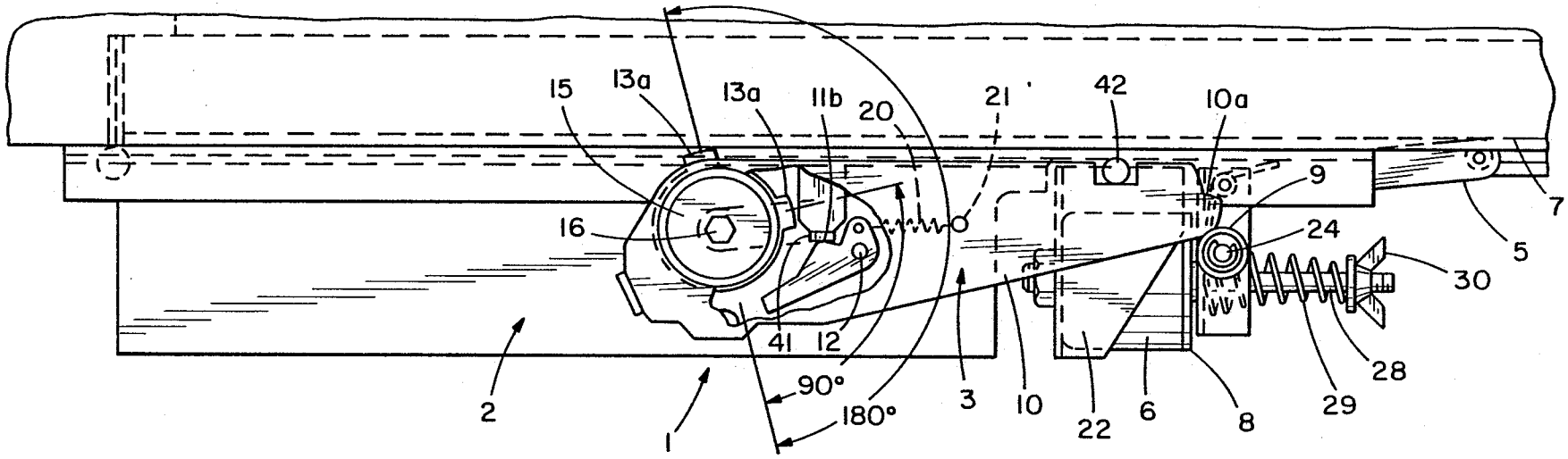
FIG. 11 is a fragmentary plan view showing the components positioned in the door closed position, with the rotor tab shown as it would be with the door fully closed if the hold-open had been set at 90 degrees and 180 degrees, respectively.

The mode of operation of door holder-closer 1 with hold open angle set at 90 degrees as in the preceding example and electromagnet 6 deenergized is as follows:

With door 7 in the closed position, all components assume the position shown in FIG. 11. In particular, rotor tab 13*a* is at 90 degrees to the hold-open angle position, armature 8 rests against electromagnet 6, and lever 10 rests against lever stop 42. As door 7 is opened, spindle 4, attached cone 14 and rotor 13 rotate clockwise. After spindle 4 rotates approximately 80 degrees (FIG. 10), rotor tab 13*a* contacts rotor tab stop face 40*a* causing lever 10 to rotate with spindle 4. As lever 10 rotates two separate actions take place simultaneously:

First, the motion of lever 10 lifts pawl 11 away from pawl release tab 41 allowing pawl spring 20 to rotate pawl 11 and engage pawl latch end 11*a* with rotor tab 13*a*.

Figure 12:
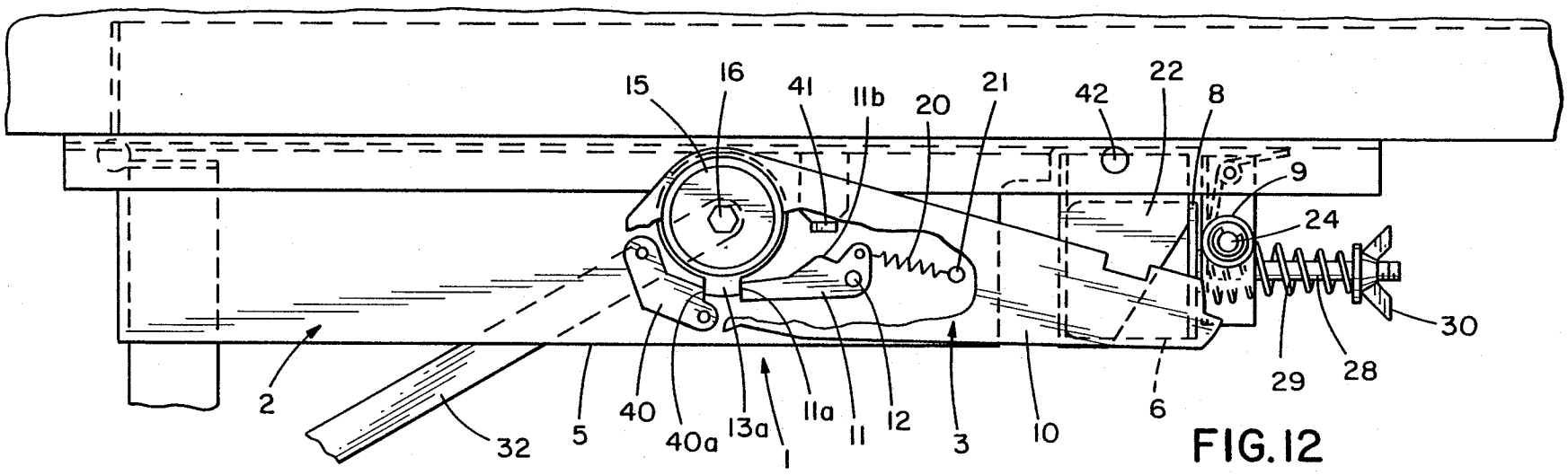
FIG. 12 is a fragmentary plan view showing the mechanism in over-travel position with the door opened to approximately 5 degrees beyond hold-open.

Second, the motion of lever 10 causes cam surface 10*b* of lever 10 to force roller 9 back against the force of armature spring 27 carrying pivot plate 25 and armature 8 away from magnet 6. As latch face 10*a* passes roller 9, armature spring 27 returns armature 8 to contact with electromagnet 6, and roller 9 into latched position (FIG. 2). This action requires an additional 9 degrees spindle rotation after rotor tab 13*a* contacts tab stop face 40*a*. At this point there is provision for an additional 5 degrees spindle rotation beyond hold open. This over-travel is shown in FIG. 12. When door 7 is manually released, door 7 immediately moves to the door closed position (FIG. 10), because lever 10 is able to cam roller 9 away from a resting position against lever latch face 10*a* due to the absence of an electromagnet 6 holding force on armature 8. Motion of lever 10 will again bring pawl release cam 11*b* into contact with pawl release tab 41, disengaging rotor tab 13*a*, and allowing spindle 4 to continue rotation to effect door closing while lever 10 remains stationary against lever stop 42, and armature spring 27 will return pivot plate 25 and armature 8 to position against face of electromagnet 6 (FIG. 11).

The detailed operation of door holder-closer 1 in the hold open mode with power applied is identical to operation with power off with the exception of the second simultaneous action hereinafter described. The second action with power applied is as follows:

The motion of lever 10 driven by spindle 4 causes cam surface 10*b* of lever 10 to force roller 9 back against the force of spring 29. Armature 8 is held in contact with electromagnet 6. As latch face 10*a* passes roller 9, spring 29 forces roller 9 into engagement with latch face 10*a* of lever 10. The restraining force exerted on lever 10 exceeds the closing force exerted by door closer 2, therefore, the unit will remain in hold-open until either sufficient force is applied to door 7 to cause manual override, or electromagnet 6 is deenergized, allowing armature 8 to move away from the magnet face, releasing spring 29 and the latch engagement force on roller 9. The over-travel provision remains unchanged.

Figure 8:
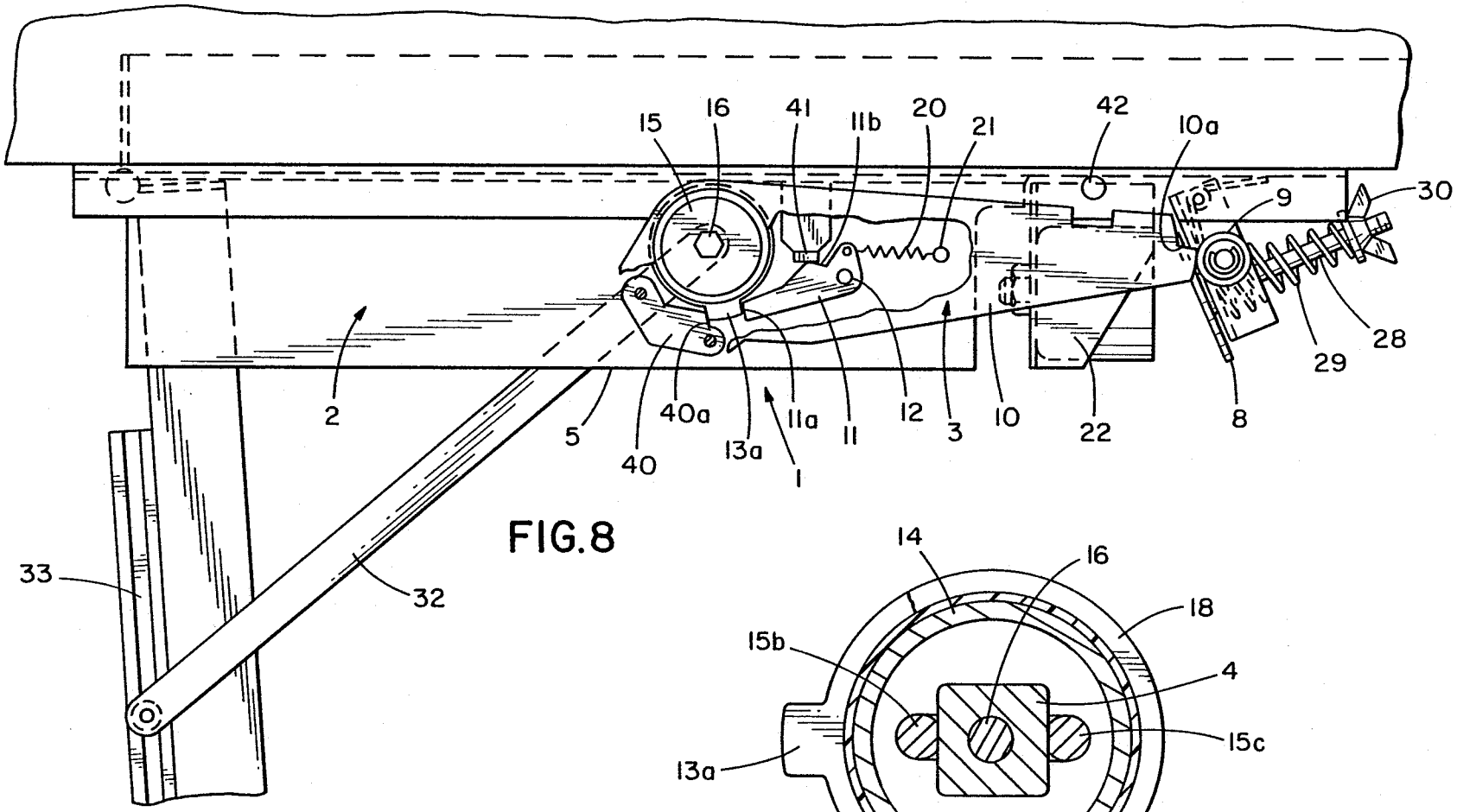
FIG. 8 is a fragmentary plan view showing the release of the lever-roller latch in response to deenergization of the electromagnet.

The detailed operation of door holder-closer 1 in response to electrical release is as follows:

When power is cut off to electromagnet 6 (with door 7 in the hold-open position of FIG. 2), electromagnet 6 ceases its magnetic holding force on armature 8, and lever 10 forces roller 9 out of engagement with lever latch face 10*a* (FIG. 8). Continued motion of lever 10 brings pawl release cam 11*b* into contact with pawl release tab 41, disengaging rotor tab 13*a*, and allowing spindle 4 to continue rotation to effect door closing while lever 10 remains stationary against lever stop 42, and armature spring 27 returns pivot plate 25 and armature 8 to position against the face of electromagnet 6 (FIG. 11).

The detailed operation of door holder-closer 1 in response to manual override has been previously described.

Plastic bearing rings 17 and 18 effect an important mode of operation not previously outlined in detail in order to simplify the description of the various modes of operation. As noted, there is a substantial difference in angular motion between spindle 4 and lever 10. Lever 10 requires an angular motion of approximately 9 degrees to effect hold open or release. There is also provision for an additional 5 degrees over-travel which is not part of the hold-open function. Spindle 4 may operate at any angular motion up to 180 degrees, or more, as determined by the requirements of the particular door where used. This angular disparity is achieved through bearing rings 17 and 18 acting in conjunction with the secondary latch. The bearing formed by the plastic rings serves the three following specific functions:

(1) the bearing supports levers 10, with primary and secondary latches in the proper position relative to spindle 4;

(2) the bearing allows relative rotary motion between spindle 4 and lever 10; and (3) the bearing serves as the reactive member to the forces generated by the primary and secondary latches in response to the restraint of spindle torque when the mechanism is in hold open.

In particular, if the hold-open angle is set at 90 degrees as measured by spindle rotation, and as the door is opened from latch or fully closed position, spindle 4, together with cone 14, rotor 13, and spindle cap 15, rotates within lever 10 as allowed by bearing rings 17 and 18. Lever 10 remains stationary. At the point of approximately 81 degrees, spindle rotation brings rotor tab 13*a* into contact with rotor tab stop face 40*a* causing lever 10 with related latching mechanisms to rotate with spindle 4. This rotation continues for 9 degrees at which point both latching mechanisms are in hold open. During this 9 degrees of spindle rotation there is no relative motion within bearing rings 17 and 18.

When the manual force which caused the door to be opened is removed, the primary and secondary latches hold the spindle in opposition to the closing force generated by the closer spring and the door is held in open position. While the mechanism is in this hold-open condition, the bearing serves as a reactive member. There is never any relative motion within the bearing while the bearing is under load.

The above actions are reversed when the door is released either electrically or by manual override.

It should be understood the above described arrangements are merely illustrative of the principles of this invention. Structural modification can be made without departing from the scope of the invention.

I claim:

1. In a door holder-closer including a door closer having a door drive spindle attachable to a door, a door holder attachable to the spindle to lock the spindle at a door hold-open position comprising a lever adapted to be coupled to the spindle to lock the spindle to a door hold-open position in response to the application of two concurrently applied latching forces and to release a door from the hold-open position in response to the removal of one of the latching forces, a first mechanism effecting a primary latch and electrically latching the lever during door opening in response to the application of an energizing electrical current to the first mechanism, a second mechanism effecting a secondary latch and mechanically latching the lever to the spindle in response to rotation of the spindle to the door hold-open position, the second latching mechanism including a pair of adjustable clamping elements seated over the spindle with one of the clamping elements being locked to the spindle and the other clamping element driving the lever in a door opening movement and also driving the lever in a door closing movement with the two clamping elements presenting inner and outer mating clamping surfaces of a generally frustoconical cross-section.

2. The combination of claim 1 in which the one clamping element is generally a frustoconical cone and the other clamping element is a rotor seated over the cone and being driven by the cone.

3. The combination of claim 2 in which the rotor includes a hold-open latching tab.

4. The combination of claim 3 including a latching pawl pivotally carried on the lever to engage and latch the rotor tab to effect hold-open of a spindle-engaged door in response to the door being opened to at least the hold-open angle.

5. The combination of claim 4 in which an overriding door-closing force breaks the latch effected by the first mechanism.

6. The combination of claim 5 in which the first latching mechanism includes an electromagnet, and an armature-driven latching element engaging the lever in response to energization of the electromagnet when the door is driven to a preset hold-open position.

7. The combination of claim 6 in which the armature-driven latching element is a roller.

8. The combination of claim 7 in which deenergization of the electromagnet releases the roller-lever latch to release a door to the door-closed position.

9. In a door holder-closer including a door closer having a door drive spindle and an electromechanical door holder attached to the drive spindle of the door closer, an improved door holder comprising an adjustable clamp having mating rotor and cone elements, a lever coupled to the drive spindle of the door closer by the adjustable clamp, with both the rotor and the cone being seated over the drive spindle and with the cone being fixed to the spindle, a pawl pivotally supported on the lever adjacent the rotor, a rotor tab projecting from the rotor to be selectively engaged by the pawl, an electromagnet, an armature actuated by the electromagnet, and a roller driven by the armature to engage selectively a hold portion of the lever, with the motion of the spindle being restrained by concurrent forces applied by a first latch formed when the roller is engaged with the hold portion of the lever in response to an energized electromagnet, and by a second latch formed when the pawl engages the rotor tab with the second latch being supported and controlled by the lever which is restrained by the first latch thereby effecting hold-open of any door whose movement is controlled by the closer spindle.

* * * * *